US008381320B2

(12) United States Patent
Wiener

(10) Patent No.: US 8,381,320 B2
(45) Date of Patent: Feb. 26, 2013

(54) HIP PROTECTION SYSTEM

(75) Inventor: Stanley L. Wiener, Naperville, IL (US)

(73) Assignee: Fallgard, LLC, Naperville, IL (US)

( * ) Notice: Subject to any disclaimer, the term of this patent is extended or adjusted under 35 U.S.C. 154(b) by 0 days.

(21) Appl. No.: 12/858,996

(22) Filed: Aug. 18, 2010

(65) Prior Publication Data

US 2011/0154562 A1 Jun. 30, 2011

Related U.S. Application Data

(63) Continuation of application No. 11/068,699, filed on Feb. 28, 2005, now abandoned.

(51) Int. Cl.
*A41D 27/26* (2006.01)

(52) U.S. Cl. ..... 2/465

(58) Field of Classification Search ..... 2/455, 465, 2/2.5, 44, 45, 69, 267, 268, 20
See application file for complete search history.

(56) References Cited

U.S. PATENT DOCUMENTS

| | | | | |
|---|---|---|---|---|
| 4,441,211 | A * | 4/1984 | Donzis | 2/459 |
| 4,507,801 | A * | 4/1985 | Kavanagh et al. | 2/462 |
| 4,573,216 | A * | 3/1986 | Wortberg | 2/465 |
| 4,805,243 | A * | 2/1989 | Gibbens et al. | 2/228 |
| 4,807,301 | A * | 2/1989 | Ferber | 2/465 |
| 4,894,867 | A * | 1/1990 | Ceravolo et al. | 2/238 |
| 4,926,883 | A * | 5/1990 | Strock | 128/888 |
| 4,969,216 | A * | 11/1990 | Guelli | 2/400 |
| 5,105,473 | A * | 4/1992 | Valtakari | 2/461 |
| 5,636,377 | A * | 6/1997 | Wiener | 2/465 |
| 5,759,167 | A * | 6/1998 | Shields et al. | 602/26 |
| 6,093,468 | A * | 7/2000 | Toms et al. | 428/67 |
| 6,347,413 | B1 | 2/2002 | Sciscente et al. | |
| 6,408,446 | B1 | 6/2002 | Carrington | |
| 6,880,269 | B2 * | 4/2005 | Falone et al. | 36/44 |

FOREIGN PATENT DOCUMENTS

| | | |
|---|---|---|
| DE | 3638718 A1 | 8/1987 |
| DE | 3804504 A1 | 8/1989 |

OTHER PUBLICATIONS

Ross et al., "Evaluation of Two Interventions to Reduce Falls and Fall Injuries: The Challenge of Hip Pads and Individualized Elimination Rounds," Key Aspects of Elder Care: Managing Falls Incontinence and Cognitive Impairment, NY Springer Pub. Co., Eds Fund Sg, Tornquist Em., Champagne MT, 1992, pp. 97-103.

Wallace et al., "Iowa FICSIT Trial: The Feasibility of Elderly Wearing a Hip Jint Protective Garment to Reduce Hip Fractures," JAGS, Mar. 1993, vol. 41, pp. 338-340.

Lauritzen et al., "Effect of external hip protectors on hip fractures," The Lancet, vol. 341, Jan. 3, 1993, pp. 11-13.

International Search Report issued on Oct. 29, 2007 in correspnding international (PCT) patent application No. PCT/US2005/006659, 3 pages.

Wiener et al., "Force Reduction by an External Hip Protector on the Human Hip After Falls," Clinical Orthopaedics and Related Research, 2002 Lippincott William & Wilkins, Inc., No. 398, pp. 157-168.

* cited by examiner

*Primary Examiner* — Tejash Patel
(74) *Attorney, Agent, or Firm* — Fitch, Even, Tabin & Flannery LLP

(57) ABSTRACT

An improved an impact force-dissipating device which can be used as part of a hip protection system is provided. The impact force-dissipating devices may be incorporated into a garment, worn comfortably, and significantly reduce the risk of hip or other bone fracture in the event of a fall or other trauma to the hip or trochanteric region.

20 Claims, 3 Drawing Sheets

Control
(No pad)
Prior Art
Pad
Inventive
Pad
Voltage (volts)
100
80
60
40
20
0
0
4
8
12
Time (milliseconds)

HIP PROTECTION SYSTEM

RELATED APPLICATIONS

This is a continuation application which is based on, and claims benefit of, U.S. application Ser. No. 11/068,699, filed on Feb. 28, 2005, which claims priority of Provisional Application Ser. No. 60/549,718, filed on Mar. 3, 2004 and they are hereby incorporated by reference.

FIELD OF THE INVENTION

The present invention provides an improved an impact force-dissipating device which can be used as part of a hip protection system. The impact force-dissipating devices may be incorporated into a garment, worn comfortably, and significantly reduce the risk of hip or other bone fracture in the event of a fall or other trauma to the hip or trochanteric region.

BACKGROUND OF THE INVENTION

Every year the geriatric population of the United States suffer 200,000 to 300,000 hip fractures. Up to 35 percent of such patients die within the first 12 months after the fracture, and 25 to 35 percent are permanently disabled. Most cases of hip fracture involve a fall and impact to the lateral thigh and trochanteric region of the femur. Falling is common after age 70 due to neuromuscular disease, cerebrovascular disease, and cardiac disease with syncopal episodes or attacks of dizziness. Furthermore, disorders such as Parkinson's Disease, Alzheimer's Disease, and stroke are associated with high annual incidence of falls and hip fractures.

At particular risk for serious hip injury resulting from falls are post-menopausal women and elderly men. This is because the trochanteric region of the femur at the hip area of elderly patients is weakened by osteoporosis and, more rarely, osteomalacia. Women lose bone mass at a rate of 1 percent per year after menopause until age 70, and then the rate of bone loss declines. Men have 20 percent more bone mass at age 40 than women, and lose bone more gradually as they age. Thus, as an individual ages the trochanteric region of the proximal femur and femoral neck become vulnerable to fracture when the individual falls laterally from a standing position to a hard surface.

The trochanteric region of the femur in elderly patients protrudes above surrounding atrophic gluteal and other hip region muscles. This protuberant trochanteric region is a vulnerable impact site when a potential fracture victim falls on his or her side. Thus, a protective device which dissipates the high localized forces imparted to the body of the wearer falls on the hip or trochanteric region may reduce the number and/or severity of hip fractures. Accordingly, it is desirable to provide a protective device which can be worn comfortably by elderly persons and which will significantly reduce the impact force to the trochanteric region of the wearer during a fall thereby decreasing the likelihood of serious hip or femur injury upon a fall from a standing position.

Prior hip protection arrangements have been shown to be insufficient in dissipating and/or absorbing a significantly high percentage of the peak impact force to the hip area associated with a fall. However, one of the most significant problems associated with previous hip protection systems is low patient compliance. Patient compliance is the degree to which the patient follows medical advice about wearing a hip protection device, typically maximizing use of protection devices is recommended. Low patient compliance has been attributed to bulkiness of the device, discomfort over prolonged periods of use, and generally poor aesthetic appearance.

Accordingly, there is a need for a protective device suitable for use by elderly persons which is comfortable to wear for extended periods (including periods of lying down and/or sleep) and provides good aesthetic appearance while still providing sufficient protection to the hip area to prevent significant injury thereto upon a fall from a standing position. Such protective devices disclosed below and claimed herein is a significant improvement over protective devices having a rigid outer shield as described in U.S. Pat. No. 5,636,377 and Wiener et al., "Force Reduction by an External Hip Protector on Human Hip after Falls," *Clin. Orthopaedics & Related Res.*, 398, 157-168 (2002), both of which are hereby incorporated by reference. Those references teach a protective pad having a rigid outer shield formed of thin layer of a rigid material such as a suitable plastic, one or more layers of shock absorbing resilient material affixed to the inside, and a concave surface of the rigid outer shield, such as rubber foam. The improvement aims to increase the dissipation of force to over 80 percent, and preferably over 90 percent, of the impact force per square inch to the trochanteric region realized from a lateral fall from a standing position. The improvement also increases patient compliance with a protective device lacking a substantially rigid component, such as a rigid shield. The improvement also provides an inner layer of polymeric material, directly adjacent to the hip region, which is soft and comfortable.

SUMMARY OF THE INVENTION

The present invention provides an improved an impact force-dissipating device which can be used as part of a hip protection system. The impact force-dissipating devices may be incorporated into a garment, worn comfortably, and significantly reduce the risk of hip or other bone fracture in the event of a fall or other trauma to the hip and/or trochanteric region.

This invention provides a protection device for the hip or trochanteric region of a human to significantly reduce the risk of hip or other bone fracture in the event of a fall or other trauma to the hip or trochanteric region, said protective device comprising (1) an outer layer comprising a first substituted poly alpha olefin and a nitrile substituted rubber composition, wherein the outer layer has a density of about 6 to about 15 lbs/ft$^3$; (2) an inner layer comprising a second substituted poly alpha olefin and a nitrile substituted rubber composition, wherein the inner layer has a density of about 3 to about 6 lbs/ft$^3$; and (3) an adhesive to bond the layers together, wherein at least the inner layer of the protection device has been heated to about 210 to about 240° F. for a time sufficient to increase the flexibility of the protective device; wherein the protective device is about 0.5 to about 1.25 thick, wherein the protective device is designed to be worn by the human with the inner layer adjacent to the hip or trochanteric region, and wherein the protective device significantly reduces the risk of hip or other bone fracture in the event of a fall or other trauma to the hip or trochanteric region when worn by the human. Preferably the protective device has an intermediate layer comprising a third substituted poly alpha olefin and a nitrile substituted rubber composition, wherein the intermediate layer has a density of about 6 to about 8 lbs/ft$^3$; of course, in such a protective device there would be two adhesive layers to bond the layers together (i.e., one to bond the outer layer and intermediate and another to bond the intermediate layer to the inner layer). Preferably, the protective device itself, instead of only the inner layer, is heated to about 210 to about 240° F. to increase the flexibility. Preferably, the protective device of the present invention dissipates or otherwise absorbs at least about 70 percent of the peak impact force and at least about 90 percent of the total impact force generated in a fall from a standing position directly on the hip or trochanteric region. Preferably a patient would use two protective devices, one on each hip, to provide higher levels of protection.

The present invention also provides a protective system for protecting the hip or trochanteric region of a human and to significantly reduce the risk of hip or other bone fracture in the event of a fall or other trauma to the hip or trochanteric region, said protective system comprising (A) a garment having an elastic means for engaging the garment over the hips and trochanteric regions of the wearer's body, wherein the garment has at least two pockets adapted to be adjacent to the hip and trochanteric regions of the wearer; (B) at least two protective devices, wherein each protection device comprises (1) an outer layer comprising a first substituted poly alpha olefin and a nitrile substituted rubber composition, wherein the outer layer has a density of about 6 to about 15 lbs/ft$^3$; (2) an inner layer comprising a second substituted poly alpha olefin and nitrile substituted rubber composition, wherein the inner layer has a density of about 3 to about 6 lbs/ft$^3$; and (3) an adhesive to bond the layers together, wherein at least the inner layer of the protection device has been heated to about 210 to about 240° F. for a time sufficient to increase the flexibility of the protective device; wherein each protective device is about 0.5 to about 1.25 inches thick, wherein each protection device is designed to fit into one of the at least two pockets so as to be maintained in a substantially stationary position relative to the wearer's body and to cover the hip and trochanteric regions when the garment is worn by the human, and wherein the protective device significantly reduces the risk of hip or other bone fracture in the event of a fall or other trauma to the hip or trochanteric region when worn by the human. Preferably the at least two protective devices have an intermediate layer comprising a third substituted poly alpha olefin and a nitrile substituted rubber composition, wherein the intermediate layer has a density of about 6 to about 8 lbs/ft$^3$; of course, in such protective devices there would be two adhesive layers to bond the layers together (i.e., one to bond the outer layer and intermediate and another to bond the intermediate layer to the inner layer). Preferably, the protective device itself, instead of only the inner layer, is heated to about 210 to about 240° F. to increase the flexibility. Preferably, the at least two protective device of the present invention dissipates or otherwise absorbs at least about 70 percent of the peak impact force and at least about 90 percent of the total impact force generated in a fall from a standing position directly onto the hip or trochanteric region.

This invention also provides a method for significantly reducing the risk of hip or other bone fracture in the event of a fall or other trauma to the hip or trochanteric region of a human, said method comprising (A) providing at least one protective device comprising (1) an outer layer comprising a first substituted poly alpha olefin and a nitrile substituted rubber composition, wherein the outer layer has a density of about 6 to about 15 lbs/ft$^3$; (2) an inner layer comprising a second substituted poly alpha olefin and a nitrile substituted rubber composition, wherein the inner layer has a density of about 3 to about 6 lbs/ft$^3$; and (3) an adhesive to bond the layers together, wherein at least the inner layer of the at least one protection device has been heated to about 210 to about 240° F. for a time sufficient to increase the flexibility of the at least one protective device; wherein the at least one protective device is about 0.5 to about 1.25 inches thick, wherein the at least one protective device is designed to be worn by the human with the inner layer adjacent to the hip or trochanteric region, and wherein the at least one protective device significantly reduces the risk of hip or other bone fracture in the event of a fall or other trauma to the hip or trochanteric region when worn by the human; and (B) having the human wear the at least protective device in a manner to cover the hip or trochanteric region such that the inner layer of the at least protective device is adjacent to the hip or trochanteric region. Preferably this method uses two protective devices and a garment adapted to maintain the two protective devices so as to cover both hip or trochanteric regions such that the inner layers are adjacent to each of the hip or trochanteric regions. Preferably the protective device or devices have an intermediate layer comprising a third substituted poly alpha olefin and a nitrile substituted rubber composition, wherein the intermediate layer has a density of about 6 to about 8 lbs/ft$^3$; of course, in such protective devices there would be two adhesive layers to bond the layers together (i.e., one to bond the outer layer and intermediate and another to bond the intermediate layer to the inner layer). Preferably, the protective device itself, instead of only the inner layer, is heated to about 210 to about 240° F. to increase the flexibility. Preferably, the protective device or device of the present invention dissipates or otherwise absorbs at least about 70 percent of the peak impact force and at least about 90 percent of the total impact force generated in a fall from a standing position directly onto the hip or trochanteric region.

DETAILED DESCRIPTION

The present invention provides an improved impact force-dissipating hip protection device which can be incorporated into a garment in order protect the hip and trochanteric region in the event of a fall. The improved force-dissipating devices, especially when used with a garment designed to accept them can be worn comfortably for relatively long periods of time (e.g., periods of about 24 to about 48 consecutive hours or more). The protective devices do not require, and preferably do not have, a substantially rigid component (e.g., a rigid, hard shield usually located on some commercially available hip protection pads). Both of these factors increase comfort levels, and thus compliance by the patient or wearer and the protection factor provided by the present protective devices. Moreover, the use of the present hip protective devices allows the dissipation of at least about 90 percent of the total impact force per square inch to the hip or trochanteric regions in lateral falls onto the hip or trochanteric regions from a standing position. Moreover, the peak force is also dissipated by at least about 70 percent using the protective devices of this invention.

The protection devices of the present invention generally have either two (inner and outer) or three (inner, intermediate, and outer) layers of substituted poly alpha olefin and nitrile substituted rubber compositions of varying densities which are bonded together with an adhesive. The densities of the layers increase going from the inner to outer layers as shown in the following tables.

| | Density (lbs/ft$^3$) | |
|---|---|---|
| | Range | Preferred Range |
| Inner Layer | 3-6 | 4-5 |
| Outer Layer | 6-15 | 9-12 |

| | Density (lbs/ft$^3$) | |
|---|---|---|
| | Range | Preferred Range |
| Inner Layer | 3-6 | 4-5 |
| Intermediate Layer | 6-8 | 6-7 |
| Outer Layer | 6-15 | 9-12 |

For the inner and outer layers, the difference in the densities should be at least 1 lbs/ft$^3$ and is preferably at least about 4 lbs/ft$^3$. Thus, for example, if the inner layer has a density of 6 lbs/ft$^3$, the density of the outer layer should be 7 lbs/ft$^3$ or more and preferably 10 lbs/ft$^3$ or more.

Figure 1:
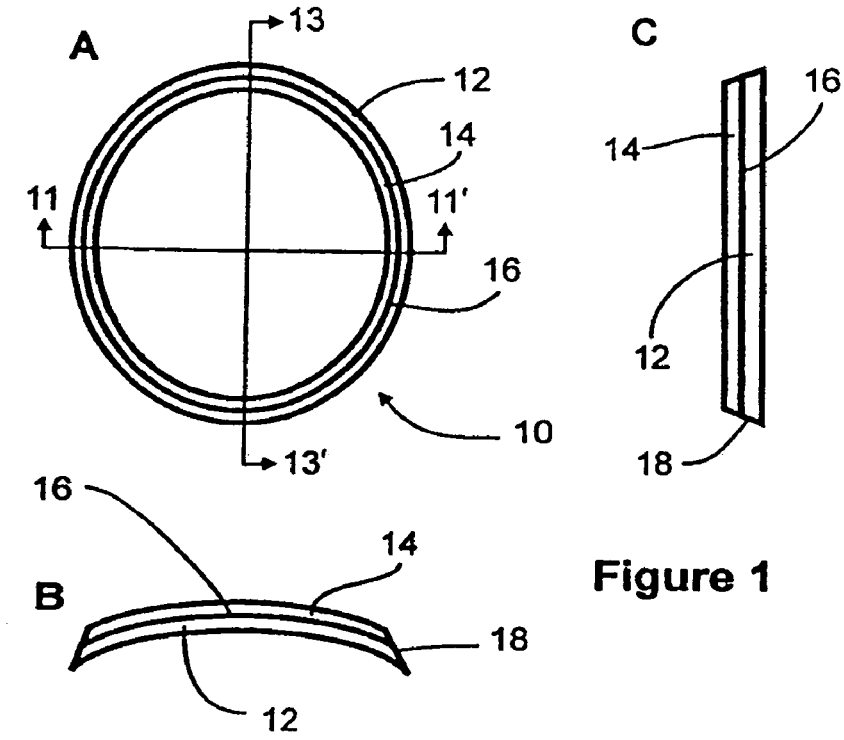
FIG. 1 illustrates a protective pad of the present invention having two layers of the polymeric composition (i.e., substituted poly alpha olefin and nitrile substituted rubber copolymer). Panel A provides a front view; Panel B provides a cross-sectional view through line 11-11'; and Panel C provides a cross-sectional view through line 13-13'.
Figure 2:
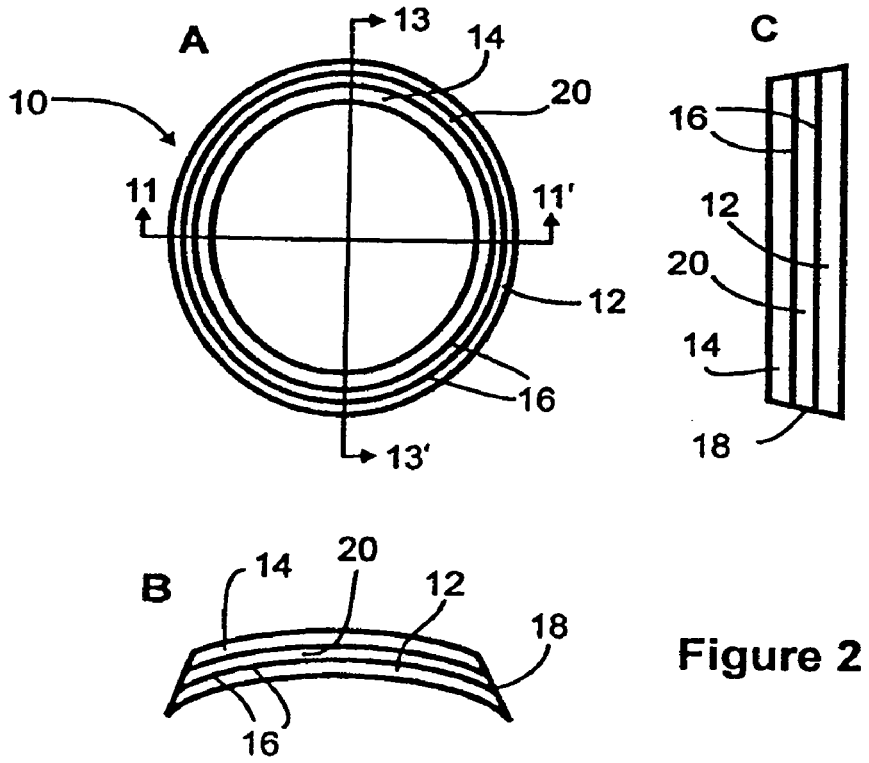
FIG. 2 illustrates a protective pad of the present invention having three layers of the polymeric composition (i.e., substituted poly alpha olefin and nitrile substituted rubber copolymer). Panel A provides a front view; Panel B provides a cross-sectional view through line 11-11; and Panel C provides a cross-sectional view through line 13-13.

FIGS. 1 and 2 illustrates protective pads of the present invention having two and three layers, respectively, of the polymer material. A two layered pad 10 is illustrated in FIG. 1 having an inner layer 12 of a lower density polymeric composition and an outer layer 14 of a higher density polymeric composition. The inner layer 12 and the outer layer 14 are bonded together with adhesive 16. As shown in cross-sectional views B (through line 11-11' in Panel A) and C (through line 13-13' in Panel A), the protective pad 10 preferably has beveled edges 18 (sloped inward from the inner layer 12 to the outer layer 14) to provide additional comfort.

A three layered pad 10 is illustrated in FIG. 2 having an inner layer 12 of the lower density polymeric composition, an intermediate layer 20 having an intermediate density polymeric composition, and an outer layer 14 of the higher density polymeric composition. The inner layer 12 and the intermediate layer 20 are bonded together with adhesive 16; likewise, the intermediate layer 20 and the outer layer 14 are also bonded together with adhesive 16. Although the adhesive used between layers 12 and 20 and between layers 20 and 14 may be different, it is generally preferred the same adhesive is used. As shown in cross-sectional views B (through line 11-11' in Panel A) and C (through line 13-13' in Panel A), the protective pad 10 preferably has beveled edges 18 (sloped inward from the inner layer 12 to the outer layer 14) to provide additional comfort.

Figure 3:
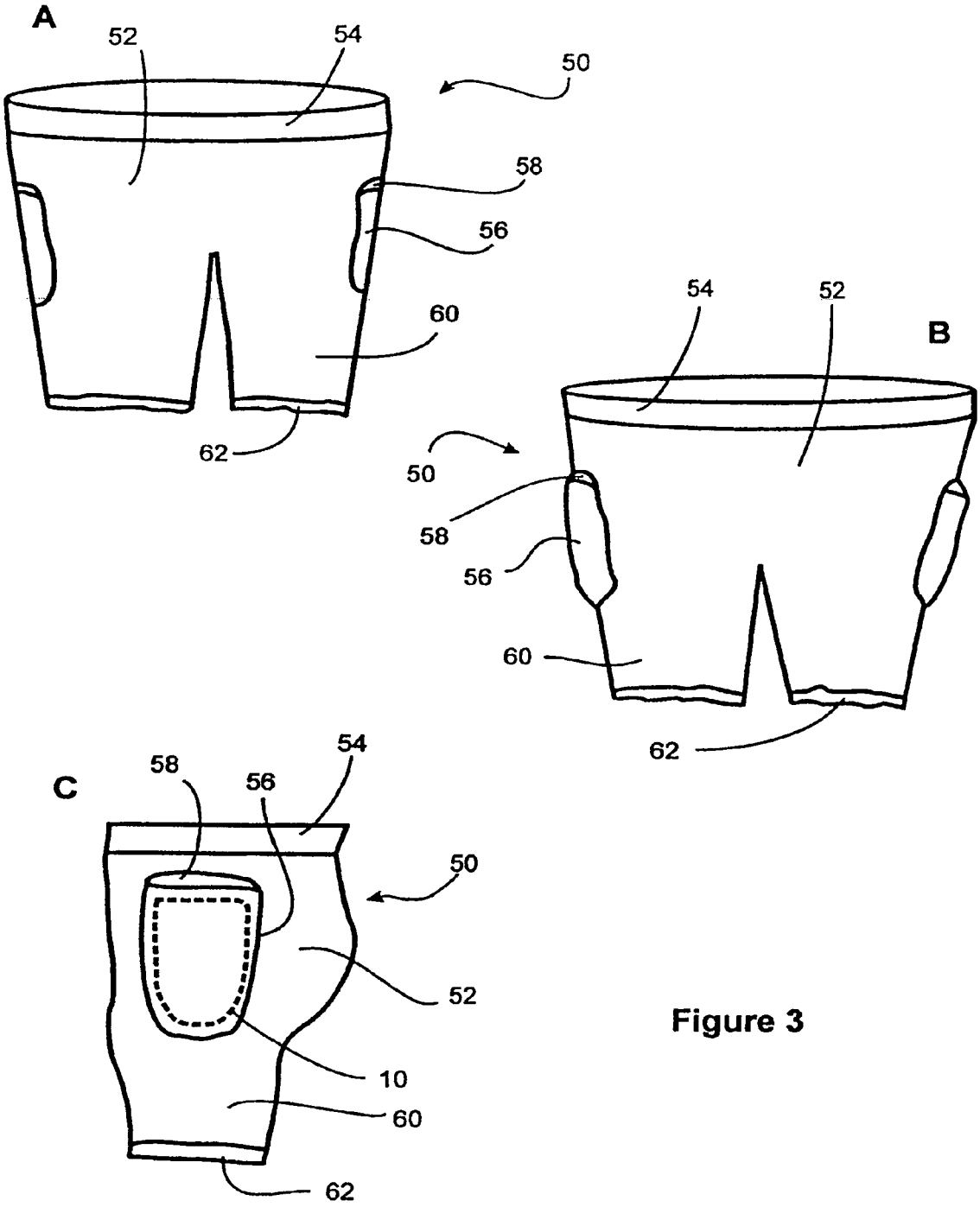
FIG. 3 illustrates a garment suitable for accepting the protective pads of the present invention to provide a hip protection system. Panel A is a front view of the garment without the protective pads in place; Panel B is a front view of the garment with the protective pads inserted in the pockets of the garment; and Panel C is a side view of the garment in Panel B.

FIG. 3 illustrates an undergarment 50 having pockets 56 to receive the protective pads 10 of the present invention. Panels A and B are front view of the undergarment 50 with and without, respectively, in the pockets 56. The undergarments have a body portion 52 with an elastic waistband 54 and leg portions 62 with elastic leg bands 62. On each side of the undergarment 50 are located pockets 56 which are designed to cover the trochanteric region and to contain the protective pads in a position to protect the trochanteric region in case of a fall. The pockets 56 are equipped with opening for insertion of the protective pads and typically also have a flap or closure mechanism 58 to keep the protective pads 10 in place within the pockets 56. Panel C provides a side view of the garment. Of course, other type garments could be used in the present invention to maintain the protective pads in proper position. For example (but not limited to), the garments described in U.S. Pat. No. 5,636,377, which has been incorporated by reference, may be used in the present invention in combination with the present protective pads.

The hip protection device is construction of at least two layers, each layer having a different density, of a polymeric composition comprising a substituted poly-α-olefin and a substituted polynitrile rubber. The two layers are bonded together or laminated with a suitable adhesive (preferably a water soluble polyurethane adhesive). Preferably the polymeric composition comprises a polyvinyl chloride polynitrile copolymer, and even more preferably a block polyvinyl chloride polynitrile copolymer. An especially preferred polymer copolymer for uses in this invention, and which can be manufactured having various densities using convention techniques, can be obtained from Der-Tex Corporation (Saco, Me.; product number WH405S). The preferred polymeric composition can be prepared by mixing about 30 to about 50 percent (preferably about 35 to about 45 percent) nitrile butyl rubber (NBR), about 30 to about 50 percent (preferably about 35 to about 45 percent) polyvinyl chloride (PVC), and 0 to about 30 percent (preferably about 10 to about 25 percent) filler (e.g., calcium carbonate, silica, other inert materials, and mixtures thereof). The mixture is then heated to about 250 to about 300° F., generally without applied pressure, to obtain an extrudable mixture. This polymeric composition is then extruded to form a sheet using hot roller techniques. The sheets are then molded at about 250 to about 300° F. using a blowing agent and/or high pressure inert gas in the mold. Suitable blowing agents are well known in the art and include inorganic or organic blowing agents so long as they provide the desired density for a particular layer and do not adversely effect the resulting polymeric properties; one especially preferred blowing agent is azodicarbonamide. The resulting sheets can then be further pressed using, for example, roller presses or stamping equipment. As is well known in the art, the conditions of manufacture can be varied to obtain the polymeric material in the desired thicknesses and densities. Alternatively, the polymeric material may be cut or sliced to obtain the desired thicknesses. Typically, densities ranging from about 3 to about 15 lb/ft$^3$ are suitable for use in the protective pads of this invention; of course, as detailed herein, specific layers within the protective pads will have specific densities.

Once sheets of the polymeric material are obtained having the desired thicknesses and densities, the sheets are laminated together using a suitable adhesive (e.g., a water soluble polyurethane adhesive material) and then cut (e.g., using die cutting equipment) to the desired dimensions. Preferably the protective pads are cut to provide beveled edge at least at the top and bottom (and preferably all outside edges) to improve comfort levels when worn. Once cut, the protective pads are subjected to a final heat treatment using a mold at about 210 to about 240° F. for time sufficient to form the final desired shape and increase the softness of the resulting pad (especially the inner layer of polymeric composition) to further improve comfort levels when worn; generally a time of about 9 to 10 minutes is sufficient although shorter or longer times may be used if necessary or desirable to obtain a softer pad so longer as the overall force dissipating properties are not adversely effected.

The total thickness of the hip protection device is about 0.5 to about 1.25 inches, preferably about 0.6 to about 0.9 inches. The hip protection device has at least two layers of the polymeric composition (an outer layer having a density of about 8 to about 15 lb/ft$^3$ and a thickness of about 0.4 to about 0.7 inches and an inner layer having a density of about 3 to about 6 lb/ft$^3$ and a thickness of about 0.2 to about 0.4 inches. More preferably the outer layer has a density of about 9 to about 12 lb/ft$^3$ and a thickness of about 0.5 to about 0.7 inches and an inner layer having a density of about 4 to about 5 lb/ft$^3$. If desired, the hip protective pads may have intermediate layers of the polymeric composition (density of about 6 to about 8 lb/ft$^3$ and a thickness of about 0.2 to about 0.4 inches provided that the total thickness remains within the limits indicated above. When worn, the outer layer is positioned outward from the body and the inner layer adjacent to the body.

The mold used for the final heat treatment is preferably configured to confirm to an average topographical outline or shape of the hip and trochanteric region of a human. More preferably, different molds can be used to fit a wide variety of individuals (e.g., women, men, very small to very large, and the like). Custom fit molds, designed for particular individuals, can also be used; indeed, for individuals with unusual shaped hip regions, deformities, or abnormalities, such custom molds may be preferred and even required. For best results, the shallow concave shape of the inner surface of the hip protection pad should be at least approximate, and preferably follow closely, the shape and contours of the hip region to be protected. The width and length of the hip protective pad can be varied as desired; again multiple sizes can be prepared to accommodate a variety of individuals. Generally, however, the width can vary from about 4 to about 6 inches and the length can vary from about 4.5 to about 9 inches or longer (e.g., longer lengths can be used, if desired, to provide additional protection of the femoral shaft stem where the patient has had a total hip replacement); of course, other dimensions can be used and, in some cases, may be preferred.

As noted above, after the device has been cut to its desired size, the protection device is then heated to about 210 to about 240° F., preferably using molds to form, or maintained, the desired shallow concave shapes for the protective pad which approximate the shallow convex shape of the hip region. This heating step is of sufficient duration (typically about 9 to about 10 minutes) to provide a softer, more comfortable protective pad but which does not adversely effect the ability of the various polymeric compositions to absorb the impact force generated in a typical fall. Since this heating step produces a protection device that is softer, more flexible and has less pronounced edges, it enhances patient compliance. Patient compliance is measured by amount of time the patient uses the protection devices. Compliance is, of course, directly related to the comfort level experienced by the wearer using the protection pad. Cosmetic appearance is also an important factor for patient compliance. The protective pads of the present invention are both softer and more flexible in use and present a more acceptable appearance when worn due to their limited thickness, thus increasing patient compliance. An important aspect of using of hip protectors to prevent fractures is maximizing use of protection devices. The limited thickness and increased softness and flexibility of the inventive pads both improve comfort and the cosmetic appearance when worn. Using a protection device with an inner layer of about 3 to about 6 lb/ft$^3$, especially in combination with the final heating step, provides a protective pad and protective systems which are comfortable enough to wear for prolonged periods.

Although the invention has been described above, it should be understood that various changes and modifications may be made without departing from the scope of the invention which is set forth in the claims appended hereto. Unless noted otherwise, all composition percentages are by weight. All reference cited herein are incorporated by reference.

Experimental Methods. Two general methods were used to evaluate both inventive hip protection pads and commercially available hip protection pads. Molds of the upper third femur were made in an effort to mimic the force on the hip region when a patient falls. Molds were made from femurs provided by the Department of Gross Anatomy of the University of Illinois at Chicago. Then, a hard polyurethane casting material (Eager Plastics, Chicago, Ill.) was used to make castings of the molds. When cured, the casting was sawed longitudinally midway between the medial and lateral surfaces of the casting. The flat side was then mounted onto a flat drop weight shelf (about 8.8 kg weight) such that the lateral femoral surface features of the casting were facing downward towards, and perpendicular to, the ground. The impact surface of casting mounted on the shelf had, therefore, the detailed geometry and topographical features typical of the impact area of an elderly person or other person in the event of a lateral fall.

A piezoelectric sensor (i.e., sensor method) was mounted longitudinally over the outer surface of the upper femoral shaft (i.e., the greater trochanter region) of the mounted casting. The sensor and the casting surface were encircled with soft natural latex rubber polymer (ranging up to about 50 mm thick) to simulate surrounding soft tissue (i.e., muscle and fat); the rubber polymer has about a 5 cm diameter circular opening through which the sensor and the casting protruded up to about 20 mm (typically about 5 to 20 mm).

A drop weight machine was used wherein the sensor and the casting could be dropped, without or with a hip protective device to be tested, using only gravity from a distance of either 0.3 m or 0.45 m to achieve a terminal velocity of about 2.2 m/sec or about 2.4 m/sec, respectively. The piezoelectric sensor was used to obtain impulse curves (i.e., voltage (proportional to force) versus time in milliseconds. The deceleration time (i.e., the time from the voltage leaving and then returning to the baseline) as well as total force and peak impact force were determined from these curves. The following equation was used to calculate the force of impact:

$$\text{Force (N)} = \text{Mass of Shelf (kg)} \times \text{Terminal velocity (m/s)} \times (\text{deceleration time (ms)})$$

Drop tests with hip protective devices in place were compared with similar drops undertaken without any protective device (control).

In an alternative method (i.e., the film method), similar casts were dropped from a height of about 0.3 m or 0.45 m so as to strike a film sensitive to force and/or pressure (e.g., Prescale Fuji film). This film contains polyester vesicles that rupture at specific force levels and release a chemical that react with a developer component or adjacent sheet to indicates a color (pale pink to deep red); the color intensity can be converted to applied force by comparing the color to a color chart and/or optical imaging method. For example, a red color indicates a higher force and a pink color a lower force. The color change occurs immediately after impact and is essentially permanent. The size and shape of the impact area was also determined directly from the film after impact. Typically, the impact area was about 0.15 to about 0.35 $in^2$ in both control experiments (using no protective device or commercially available hip protection pads) and experiments using the inventive protective device. The small size of the impact area may be due to the elevation (about 0.25 to about 0.35 inch) of the distal third of the greater trochanter above the level of the shaft of the femur. Moreover, this may help explain that fractures of the upper leg typically localize to the hip and not the remainder of the femur.

Both the sensor method and the film method provided similar results (correlation coefficient of about 0.67 with p=0.002).

EXAMPLE

Inventive devices containing differing thicknesses of either two or three layers of the polymeric compositions (each layer having different densities) as well as commercially available protective pads were tested using both the sensor method and the film method as described above; control drops were also made without any protective devices. All experiments were conducted using drops of either 0.3 or 0.45 m. Generally, about 3 to 20 drops were conducted for each set of conditions using the sensor method. Controlled drops (no protective pad) from about 0.3 and 0.45 m produced impact forces of approximately 6600 Newtons and 8700 Newtons, respectively. Both inventive and commercially available hip protection devices were tested by placing the devices, one at a time, over the curved surface of the cast having the detailed geometry and topographical features typical of the impact area of an elderly person in the event of a fall and conducting the drop using both the sensor method and the film method; generally, both methods were carried out simultaneously.

Five different inventive protective devices, containing either two or three layers of the polymeric composition, were tested. The densities of the polymeric material used for the inner layer, intermediate layer (if present), and outer layer were about 4 $lbs/ft^3$, 7 $lbs/ft^3$, and 10 $lbs/ft^3$, respectively. Each of these inventive pads had a width of about 5 inches and a length of about 7 inches. Overall thickness of the inventive pads ranged from about 0.75 to about 0.88 inches. The thickness of the individual layers as well as the results obtained (expressed in percentages relative to control runs where no protective device was used) with both the sensor method and the film method are provided in Table 1 below.

For comparison purposes, several commercially available hip protection devices were tested in a similar manner. The results obtained with the prior art devices, as well as their major characteristics, are shown in Table 2. The following prior art devices were evaluated (1) HipSaver® pad from HipSaver (Canton, Mass.); Posey Hipster® pad from J.T. Pasey, Arcadia, Calif.; Prevent Gerihip® pad from Prevent Products, Minneapolis, Minn.; Plum Protecta Hip® pad from Plum Enterprises, Valley Forge, Pa.; and FallGard® EVA pad from FallGard LLC, Naperville, Ill.

TABLE 1

Results for Various Inventive Pads

| | Thickness (inches) | | | | Piezoelectric Sensor Results | | | Film Results |
|---|---|---|---|---|---|---|---|---|
| Inventive Pad | Outer Layer (density = 10 $lb/ft^3$) | Middle Layer (density = 7 $lb/ft^3$) | Inner Layer (density = 4 lb/ft*) | Total | Total Force Reduction (%) | Peak Force Reduction (%) | Deceleration Time Increase (%) | Total Force Reduction (%) |
| 1 | 0.57 | — | 0.18 | 0.75 | 93 ± 0.3 | 74 ± 0.9 | 346 | 98 |
| 2 | 0.62 | — | 0.18 | 0.80 | 94 ± 0.2 | 74 ± 0.2 | 345 | 96 |
| 3 | 0.50 | 0.12 | 0.25 | 0.87 | 95 ± 0.1 | 73 ± 0.5 | 400 | 95 |
| 4 | 0.37 | 0.25 | 0.25 | 0.87 | 95 ± 0.2 | 74 ± 1.3 | 436 | 96 |
| 5 | 0.31 | 0.31 | 0.25 | 0.87 | 94 ± 0.2 | 74 ± 1.1 | 451 | 93 |

TABLE 2

Results for Commercially Available Pads

| | Dimensions (inches) | | | Piezoelectric Sensor Results | | | Film Results |
|---|---|---|---|---|---|---|---|
| Prior Art Pad | Thickness | Width × Length | Consistency | Total Force Reduction (%) | Peak Force Reduction (%) | Deceleration Time Increase (%) | Total Force Reduction (%) |
| HipSaver ® | 0.5 | 8 × 7 ellipse<br>7 × 7 square | Soft & fully compressible | 66 ± 4 | 26 ± 4 | 150 | 47 |
| Posey Hipster ® | 0.5 | 7 × 6.75 ellipse | Moderately firm & fully compressible | 61 ± 5 | 22 ± 3 | 143 | 15 |
| Prevent Gerihip ® | 0.5 | 8.5 × 6.5 ellipse | Soft & fully compressible | 61 ± 4 | 10 ± 3 | 155 | 41 |
| Plum Protecta ® | 0.25 | 16 × 9 | Soft & fully compression | 56 ± 1 | 0 | 0 | 3 |
| FallGard ® EVA | 0.635 | 6.75 × 4.7 | Moderately soft & minimally compressible | 80 ± 2 | 37 ± 5 | 306 | 50 |

Figure 4:
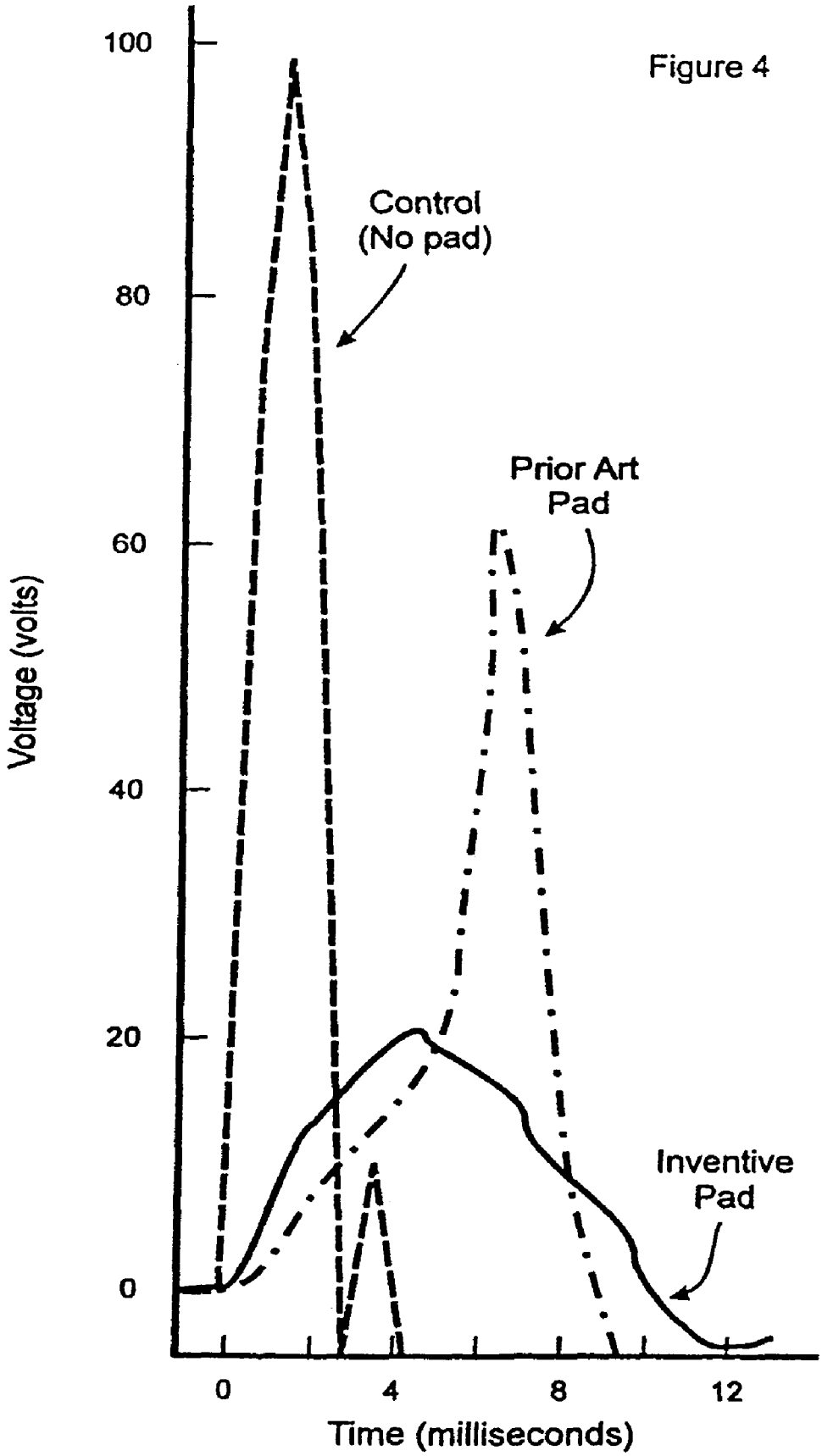
FIG. 4 includes impulse curves generated using the sensor method for a control (no protective pad), a commercially available pad (HipSaver®), and a protective pad of the present invention.

As can be seen by comparing the results of Table 1 (protective devices) to the results of Table 2 (prior art protective devices), the inventive devices represent a significant improvement over the protective pads tested. For example, the inventive devices provide a reduction in total impact force of greater than 90 percent (both sensor and film methods) as compared to the about 80 percent (sensor method) and about 50 percent (film method) reduction for the best commercially available device tested (i.e., FallGard® EVA pad). The inventive devices provides a reduction in peak impact force of greater than about 70 percent whereas the best commercially available device tested (again the FallGard® EVA pad) provided a reduction of less than about 40 percent. The increase in deceleration time for the inventive devices was also improved relative to the commercially available devices. This improvement is also clearly shown in FIG. 4, where the impulse curve for an inventive pad is compared to both a control (no protective pad) and the commercially available HipSaver® pad. The data in Table 1 also suggests that addition of an intermediate layer of the polymeric composition having a density intermediate between the inner and outer layer (Pads 3, 4, and 5), while not significantly affecting the reduction in total or peak force, does significantly increase deceleration time relative to the two layer devices (Pads 1 and 2). But it should also be noted that only slightly increasing the thickness of the outer layer in Pad 2 does significantly increases deceleration time relative to Pad 1 and almost to the levels for the three layer pads.

What is claimed is:

1. A protection device for the hip or trochanteric region of a human to significantly reduce the risk of hip or other bone fracture in the event of a fall or other trauma to the hip or trochanteric region, said protective device comprising (1) an outer layer comprising a first substituted poly-α-olefin and substituted polynitrile rubber composition, wherein the outer layer has a density of about 6 to about 15 lbs/ft$^3$; (2) an inner layer comprising a second substituted poly alpha olefin and nitrite substituted rubber composition, wherein the inner layer has a density of about 3 to about 6 lbs/ft$^3$; and (3) an adhesive to bond the layers together, wherein at least the inner layer of the protection device has been heated to about 210 to about 240° F. for a time sufficient to increase the flexibility of the protective device; wherein the protective device is about 0.5 to about 1.25 inches thick, wherein the protective device does not include a substantially rigid component, wherein the protective device is designed to be worn by the human with the inner layer adjacent to the hip or trochanteric region, and wherein the protective device significantly reduces the risk of hip or other bone fracture in the event of a fall or other trauma to the hip or trochanteric region when worn by the human.

2. The protection device of claim 1, wherein the first and second substituted poly-α-olefin and substituted polynitrile rubber compositions comprise a polyvinyl chloride polynitrile copolymer and wherein the protection device dissipates at least about 90 percent of total impact force on the hip and trochanteric region when the human, wearing the protection device to protect the hip and trochanteric region, experiences a fall or other trauma to the hip and trochanteric region.

3. The protection device of claim 2, wherein the protection device has been heated to about 210 to about 240° F. for a time sufficient to increase the flexibility of the protective device.

4. The protection device of claim 2, wherein the total thickness of the protection device is about 0.6 to about 0.9 inches, the thickness of the inner layer is about 0.2 to about 0.4 inches, and the thickness of the outer layer is about 0.5 to about 0.7 and wherein the density of the outer layer is about 9 to about 12 lbs/ft$^3$ and the density of the inner layer is about 4 to 5 lbs/ft$^3$.

5. The protection device of claim 4 further comprising an intermediate layer of a third substituted poly-α-olefin and substituted polynitrile rubber composition having a density of about 6 to about 8 lbs/ft$^3$, wherein the intermediate layer is located between the inner and outer layers and is bonded to the inner and outer layers with the adhesive.

6. The protection device of claim 1, wherein the adhesive is a water soluble polyurethane adhesive.

7. A protection system for protecting the hip or trochanteric region of a human and to significantly reduce the risk of hip or other bone fracture in the event of a fall or other trauma to the hip or trochanteric region, said protective system comprising (A) a garment having an elastic means for engaging the garment over the hips and trochanteric regions of the wearer's body, wherein the garment has two pockets adapted to be adjacent to the hip and trochanteric regions of the wearer; (B) two protective devices, wherein each protection device comprises (1) an outer layer comprising a first substituted poly-α-olefin and substituted polynitrile rubber composition, wherein the outer layer has a density of about 6 to about 15 lbs/ft$^3$; (2) an inner layer comprising a second substituted poly-α-olefin and substituted polynitrile rubber composition, wherein the inner layer has a density of about 3 to about 6 lbs/ft$^3$; and (3) an adhesive to bond the layers together, wherein at least the inner layer of the protection devices have been heated to about 210 to about 240° F. for a time sufficient to increase the flexibility of the protective device; wherein the protective devices are about 0.5 to about 1.25 inches thick, wherein the protective devices do not include a substantially rigid component, wherein the protection devices are designed to fit into the pockets so as to be maintained in a substantially stationary position relative to the wearer's body and to cover the hip and trochanteric regions when the garment is worn by the human, and wherein the protective devices significantly reduce the risk of hip or other bone fracture in the event of a fall or other trauma to the hip or trochanteric region when worn by the human.

8. The protection system of claim 7, wherein the garment has a waist portion and two leg portions, wherein the garment extends from the waist portion in proximity with iliac crest of the wearer to the leg portions in proximity with both thigh regions of the wearer and the thigh regions of the wearer are encircled by the leg portions.

9. The protection system of claim 7, wherein the first and second substituted poly-α-olefin and substituted polynitrile rubber compositions comprise a polyvinyl chloride polynitrile copolymer and wherein the protection devices dissipate at least about 90 percent of total impact force on the hip and trochanteric region when the human, wearing the protection devices to protect the hip and trochanteric region, experiences a fall or other trauma to the hip and trochanteric region.

10. The protection system of claim 9, wherein the protection devices have been heated to about 210 to about 240° F. for a time sufficient to increase the flexibility of the protective devices.

11. The protection system of claim 9, wherein the total thickness of the protection devices is about 0.6 to about 0.9 inches, the thickness of the inner layer is about 0.2 to about 0.4 inches, and the thickness of the outer layer is about 0.5 to about 0.7.

12. The protective system of claim 11, wherein the density of the outer layer is about 9 to about 12 lbs/ft$^3$ and the density of the inner layer is about 4 to 5 lbs/ft$^3$.

13. The protection system of claim 7, wherein the protective devices further comprise an intermediate layer of a third substituted poly-α-olefin and substituted polynitrile rubber composition having a density of about 6 to about 8 lbs/ft$^3$, wherein the intermediate layer is located between the inner and outer layers and is bonded to the inner and outer layers with the adhesive.

14. The protection system of claim 7, wherein the adhesive is a water soluble polyurethane adhesive.

15. A method for significantly reducing the risk of hip or other bone fracture in the event of a fall or other trauma to the hip or trochanteric region of a human, said method comprising (A) providing at least one protective device comprising (1) an outer layer comprising a first substituted poly-α-olefin and substituted polynitrile rubber composition, wherein the outer layer has a density of about 6 to about 15 lbs/ft$^3$; (2) an inner layer comprising a second substituted poly-α-olefin and substituted polynitrile rubber composition, wherein the inner layer has a density of about 3 to about 6 lbs/ft$^3$; and (3) an adhesive to bond the layers together, wherein at least the inner layer of the at least one protection device has been heated to about 210 to about 240° F. for a time sufficient to increase the flexibility of the at least one protective device; wherein the at least one protective device is about 0.5 to about 1.25 inches thick, wherein the at least one protective device does not include a substantially rigid component, wherein the at least one protective device is designed to be worn by the human with the inner layer adjacent to the hip or trochanteric region, and wherein the at least one protective device significantly reduces the risk of hip or other bone fracture in the event of a fall or other trauma to the hip or trochanteric region when worn by the human; and (B) having the human wear the at least one protective device in a manner to cover the hip or trochanteric region such that the inner layer of the at least one protective device is adjacent to the hip or trochanteric region.

16. The method of claim 15, wherein the first and second substituted poly-α-olefin and substituted polynitrile rubber compositions comprise a polyvinyl chloride polynitrile copolymer and wherein the at least one protection device dissipates at least about 90 percent of total impact force on the hip and trochanteric region when the human, wearing the at least one protection device to protect the hip and trochanteric region, experiences a fall or other trauma to the hip and trochanteric region.

17. The method of claim 16, wherein the at least one protection device has been heated to about 210 to about 240° F. for a time sufficient to increase the flexibility of the at least one protective device.

18. The method of claim 16, wherein the total thickness of the at least one protection device is about 0.6 to about 0.9 inches, the thickness of the inner layer is about 0.2 to about 0.4 inches, and the thickness of the outer layer is about 0.5 to about 0.7 and wherein the density of the outer layer is about 9 to about 12 lbs/ft$^3$ and the density of the inner layer is about 4 to 5 lbs/ft$^3$.

19. The method of claim 15, wherein the at least one protective device further comprise an intermediate layer of a third substituted poly-α-olefin and substituted polynitrile rubber composition having a density of about 6 to about 8 lbs/ft$^3$, wherein the intermediate layer is located between the inner and outer layers and is bonded to the inner and outer layers with the adhesive.

20. The method of claim 15, wherein the adhesive is a water soluble polyurethane adhesive.

* * * * *